US006463937B1

(12) United States Patent
Cloutier et al.

(10) Patent No.: US 6,463,937 B1
(45) Date of Patent: Oct. 15, 2002

(54) PORTABLE DENTAL HYGIENE SYSTEM

(76) Inventors: Cathy L. Cloutier, 2016 N. Bolivar Ct., Simi Valley, CA (US) 93063; John W. Cloutier, 2016 N. Bolivar Ct., Simi Valley, CA (US) 93063

( * ) Notice: Subject to any disclaimer, the term of this patent is extended or adjusted under 35 U.S.C. 154(b) by 0 days.

(21) Appl. No.: 09/849,422

(22) Filed: May 4, 2001

(51) Int. Cl.[7] ..... A45D 44/18; A46B 11/00

(52) U.S. Cl. ..... 132/309; 132/310; 132/308; 132/311

(58) Field of Search ..... 132/309, 308, 132/310, 311; 401/184, 145, 153, 289, 270, 282; 15/167.1

(56) References Cited

U.S. PATENT DOCUMENTS 2,303,667 A * 12/1942 Taborski ..... 132/309
2,978,722 A * 4/1961 Kusakabe ..... 132/308
4,530,129 A 7/1985 Labick et al.
4,530,369 A * 7/1985 Adams ..... 132/309
4,580,588 A * 4/1986 Swope ..... 132/309
4,583,563 A * 4/1986 Turner ..... 132/309
4,850,730 A * 7/1989 Jimenez et al. ..... 401/184
4,987,910 A 1/1991 Lowe
5,040,553 A 8/1991 Londono et al.
5,044,386 A 9/1991 Nelson
D336,782 S 6/1993 Vela et al.
5,490,530 A 2/1996 Snowden
5,865,195 A * 2/1999 Carter ..... 132/309
5,974,619 A * 11/1999 Weihrauch ..... 15/186
6,179,503 B1 * 1/2001 Taghavi-Khanghah ..... 401/184

* cited by examiner

*Primary Examiner*—John J. Wilson
*Assistant Examiner*—Robyn Kieu Doan

(57) ABSTRACT

A portable dental hygiene system including a housing which is substantially elongate and hollow, the housing includes a handle portion used to facilitate grasping the housing by a human hand and a distribution portion; a quantity of toothpaste is positioned within the housing and is used as a dentifrice for facilitating the cleansing of the user's teeth; and a plurality of bristles is coupled to said distribution portion of the housing, the bristles provide an abrasive surface for facilitating the cleansing of the user's teeth.

1 Claim, 2 Drawing Sheets

PORTABLE DENTAL HYGIENE SYSTEM

BACKGROUND OF THE INVENTION

1. Field of the Invention

The present invention relates to toothbrushes and more particularly pertains to a new portable dental hygiene system for providing a convenient portable dental hygiene system.

2. Description of the Prior Art

The use of toothbrushes is known in the prior art. More specifically, toothbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,490,530; 4,987,910; 4,530,129; 5,040,553; 5,044,386; and Des. 336,782.

While these devices fulfill their respective, particular objectives and requirements, the aforementioned patents do not disclose a new portable dental hygiene system. The inventive device includes a housing which is substantially elongate and hollow, the housing includes a handle portion used to facilitate grasping the housing by a human hand and a distribution portion; a quantity of toothpaste is positioned within the housing and is used as a dentifrice for facilitating the cleansing of the user's teeth; and a plurality of bristles is coupled to said distribution portion of the housing, the bristles provide an abrasive surface for facilitating the cleansing of the user's teeth.

In these respects, the portable dental hygiene system according to the present invention substantially departs from the conventional concepts and designs of the prior art, and in so doing provides an apparatus primarily developed for the purpose of providing a convenient portable dental hygiene system.

SUMMARY OF THE INVENTION

In view of the foregoing disadvantages inherent in the known types of toothbrushes now present in the prior art, the present invention provides a new portable dental hygiene system construction wherein the same can be utilized for providing a convenient portable dental hygiene system.

The general purpose of the present invention, which will be described subsequently in greater detail, is to provide a new portable dental hygiene system apparatus and method which has many of the advantages of the toothbrushes mentioned heretofore and many novel features that result in a new portable dental hygiene system which is not anticipated, rendered obvious, suggested, or even implied by any of the prior art toothbrushes, either alone or in any combination thereof.

To attain this, the present invention generally comprises a housing which is substantially elongate and hollow, the housing includes a handle portion used to facilitate grasping the housing by a human hand and a distribution portion; a quantity of toothpaste is positioned within the housing and is used as a dentifrice for facilitating the cleansing of the user's teeth; and a plurality of bristles is coupled to said distribution portion of the housing, the bristles provide an abrasive surface for facilitating the cleansing of the user's teeth.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description. or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable dental hygiene system apparatus and method which has many of the advantages of the toothbrushes mentioned heretofore and many novel features that result in a new portable dental hygiene system which is not anticipated, rendered obvious, suggested, or even implied by any of the prior art toothbrushes, either alone or in any combination thereof.

It is another object of the present invention to provide a new portable dental hygiene system which may be easily and efficiently manufactured and marketed.

It is a further object of the present invention to provide a new portable dental hygiene system which is of a durable and reliable construction.

An even further object of the present invention is to provide a new portable dental hygiene system which is susceptible of a low cost of manufacture with regard to both materials and labor, and which accordingly is then susceptible of low prices of sale to the consuming public, thereby making such portable dental hygiene system economically available to the buying public.

Still yet another object of the present invention is to provide a new portable dental hygiene system which provides in the apparatuses and methods of the prior art some of the advantages thereof, while simultaneously overcoming some of the disadvantages normally associated therewith.

Still another object of the present invention is to provide a new portable dental hygiene system for providing a convenient portable dental hygiene system.

Yet another object of the present invention is to provide a new portable dental hygiene system which includes a housing which is substantially elongate and hollow, the housing includes a handle portion used to facilitate grasping the housing by a human hand and a distribution portion; a quantity of toothpaste is positioned within the housing and is used as a dentifrice for facilitating the cleansing of the user's teeth; and a plurality of bristles is coupled to said distribution portion of the housing, the bristles provide an abrasive surface for facilitating the cleansing of the user's teeth.

Still yet another object of the present invention is to provide a new portable dental hygiene system that is disposable.

Even still another object of the present invention is to provide a new portable dental hygiene system that promotes better oral hygiene by making brushing and flossing more convenient.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
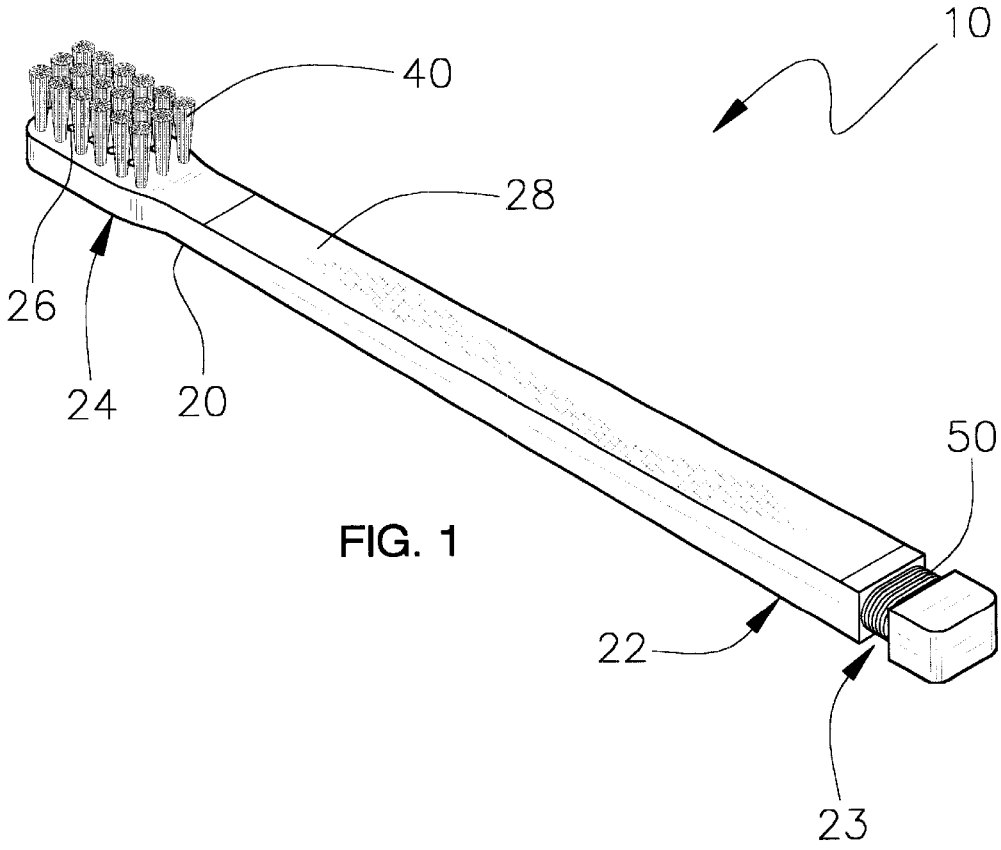
FIG. 1 is a schematic perspective view of a new portable dental hygiene system according to the present invention.
Figure 2:
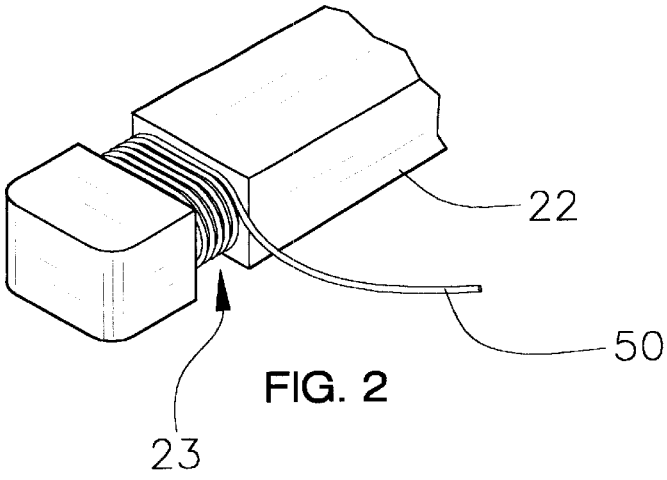
FIG. 2 is a schematic detail view of the present invention.
Figure 3:
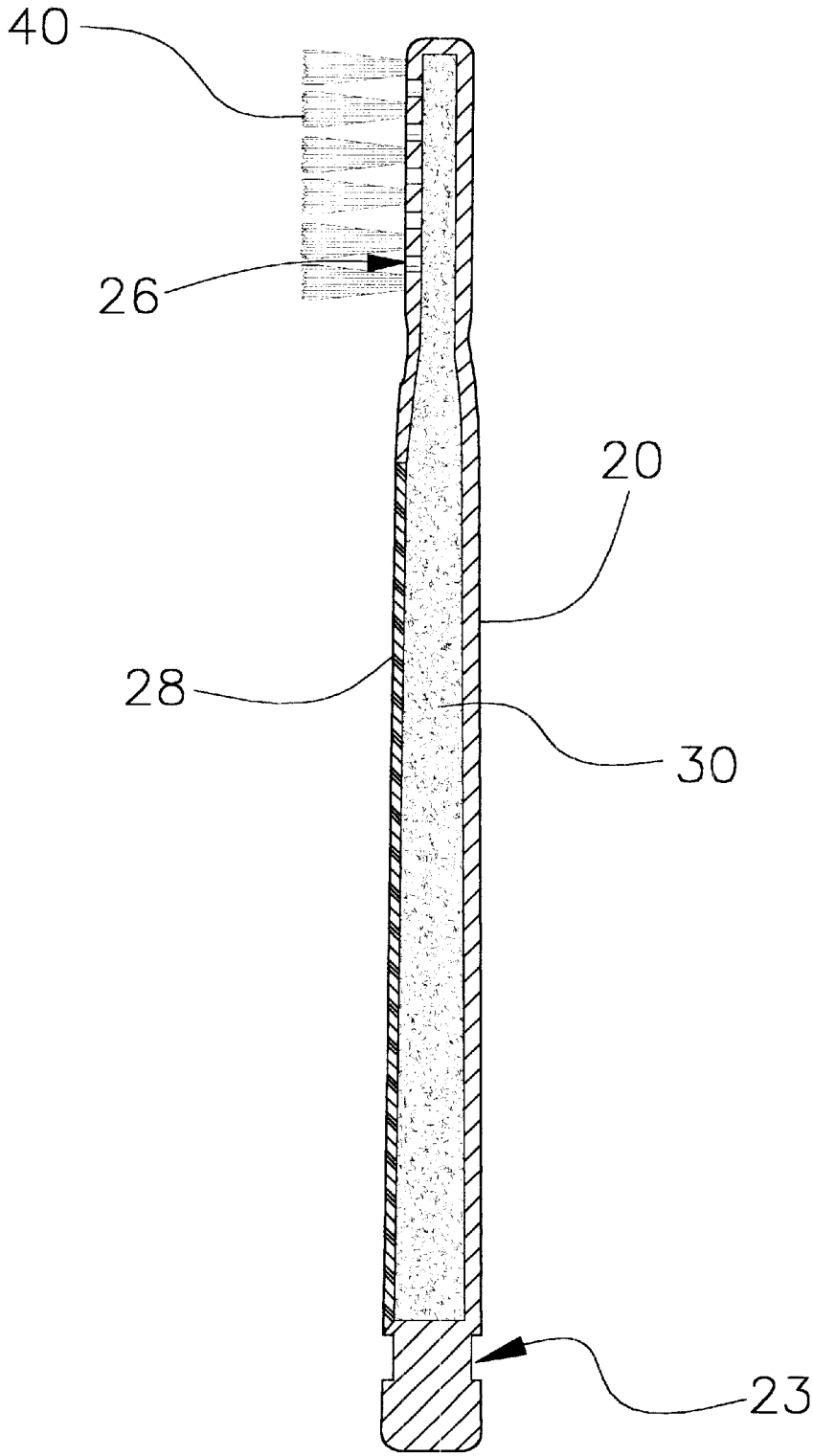
FIG. 3 is a schematic cross-sectional view of the present invention.

With reference now to the drawings, and in particular to FIGS. 1 through 6 thereof, a new portable dental hygiene system embodying the principles and concepts of the present invention and generally designated by the reference numeral 10 will be described.

As best illustrated in FIGS. 1 through 6, the portable dental hygiene system 10 generally comprises an housing 20, a quantity of toothpaste 30, a plurality of bristles 40, and a quantity of dental floss 50.

The housing 20 is substantially elongate. The housing 20 is substantially hollow. The housing 20 includes a handle portion 22 and a distribution portion 24. The handle portion 22 facilitates grasping the housing 20 by a human hand.

The quantity of toothpaste 30 positioned within the housing 20. The toothpaste 30 serves as a dentifrice to aid in the cleansing of the user's teeth.

The plurality of bristles 40 is coupled to the distribution portion 24 of the housing 20. The bristles 40 provide an abrasive surface for facilitating the cleansing of the user's teeth.

A plurality of apertures 26 is positioned in the distribution portion 24 of the housing 20. The apertures 26 are positioned adjacent to the plurality of bristles 40. The plurality of apertures 26 is used to facilitate the flow of the quantity of toothpaste 30 from within the housing 20 to an exterior surface of the distribution portion 24.

The housing 20 includes a front wall 28, which is resiliently flexible for facilitating the extrusion of the quantity of toothpaste 30 through the apertures 26 when the user applies a compressive force to the front wall 28.

The housing 20 further comprising a channel 23 formed adjacent to an end of the handle portion 22 of the housing 20. The channel 23 provides a storage area for the quantity of dental floss 50.

The quantity of dental floss 50 is positioned around the channel 23 of the handle 22 such that the dental floss 50 is substantially wrapped around the handle portion 22 in the channel 23. The quantity of dental floss 50 is used to facilitate cleaning between teeth.

In an embodiment, the housing 20 has a length between 3½ inches and 4 inches.

In a further embodiment the housing 20 has a width of approximately ¾ of an inch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable dental hygiene system comprising:

a housing being substantially elongate, said housing being substantially hollow, said housing having a handle portion and a distribution portion, said handle portion facilitating grasping said housing by a human hand;

a quantity of toothpaste positioned within said housing;

a plurality of bristles coupled to said distribution portion of said housing; said bristles providing an abrasive surface for facilitating the cleansing of the user's teeth;

a plurality of apertures positioned in said distribution portion of said housing, said apertures being positioned adjacent to said plurality of bristles, said plurality of aperture being used to facilitate the flow of the quantity of toothpaste from within said housing to an exterior surface of said distribution portion;

said housing having a front wall, substantially an entirety of said front wall being resiliently flexible for facilitating the extrusion of said quantity of toothpaste through said apertures when the user applies a compressive force to said front wall;

a quantity of dental floss, said quantity of dental floss being used to facilitate cleaning between teeth;

said housing further comprising a channel formed adjacent to an end or said handle portion of said housing, said channel providing a storage area for said quantity of dental floss; and said quantity of dental floss being positioned around said channel of said handle such that said dental floss is substantially wrapped around said handle portion in said channel.

* * * * *